US009675193B1

(12) United States Patent
Sorensen

(10) Patent No.: US 9,675,193 B1
(45) Date of Patent: Jun. 13, 2017

(54) COMPRESSION SOCK-DONNING AID

(71) Applicant: Thomas Sorensen, Centerfield, UT (US)

(72) Inventor: Thomas Sorensen, Centerfield, UT (US)

( * ) Notice: Subject to any disclaimer, the term of this patent is extended or adjusted under 35 U.S.C. 154(b) by 0 days.

(21) Appl. No.: 14/937,077

(22) Filed: Nov. 10, 2015

(51) Int. Cl.
*A47G 25/90* (2006.01)

(52) U.S. Cl.
CPC ..... *A47G 25/905* (2013.01); *A47G 25/90* (2013.01)

(58) Field of Classification Search
CPC .... A47G 25/905; A47G 25/90; A47G 25/904; D06F 59/08; D06C 3/08; B44D 3/185
See application file for complete search history.

(56) References Cited

U.S. PATENT DOCUMENTS 602,459 A * 4/1898 Lare et al. ..... D06F 59/08 38/102.9
3,070,271 A * 12/1962 Kennedy, Sr. ..... A47G 25/905 223/111
3,227,335 A * 1/1966 Minnema ..... A47G 25/908 223/111
3,806,008 A 4/1974 De Lettre
4,130,226 A * 12/1978 Farrell ..... A47G 25/905 223/111
4,765,520 A * 8/1988 Barton ..... A47G 25/905 223/111
5,050,783 A 9/1991 Hunter
D365,913 S 1/1996 Ballard
D440,740 S * 4/2001 Anctil ..... D2/641
6,971,561 B2 12/2005 Sawlewicz
7,395,951 B2 7/2008 Clayman
8,656,918 B1 * 2/2014 Alley ..... A61F 2/80 128/845
8,919,620 B2 12/2014 Taylor et al.
2008/0110945 A1 * 5/2008 Cookman ..... A47G 25/905 223/111
2009/0120975 A1 5/2009 Schoepe

FOREIGN PATENT DOCUMENTS

WO WO03082062 A1 10/2003

* cited by examiner

*Primary Examiner* — Ismael Izaguirre
(74) *Attorney, Agent, or Firm* — Kyle A. Fletcher, Esq.

(57) ABSTRACT

The compression sock-donning aid includes an annular member from which a fixed handle extends radially. An actuator handle extends radially from the annular member. Moreover, the actuator handle is able to rotate with respect to the annular member and the fixed handle. The actuator handle is in mechanical connection with a plurality of fingers provided within a central hole of the annular member. Each of the plurality of fingers is able to extend inwardly or retract outwardly with respect to a central point. Rotation of the actuator handle extends or retracts the plurality of fingers. The plurality of fingers is adapted to engage a compression sock so as to aid in opening up said compression sock during the donning process whereby a user inserts a limb into said compression sock.

12 Claims, 6 Drawing Sheets

COMPRESSION SOCK-DONNING AID

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

The present invention relates to the field of compression socks, more specifically, a device that aids in donning the compression sock onto the leg of the end user.

Compression socks are worn to aid in improving circulation to a leg of an end user. Compression socks can be difficult to put on because a compression sock is a tight-fitting sock.

What is needed and is accomplished via the device of the present disclosure is a device that aids in opening up a compression sock in order to aid in donning the compression sock onto the limb of an end user.

SUMMARY OF INVENTION

The compression sock-donning aid includes an annular member from which a fixed handle extends radially. An actuator handle extends radially from the annular member. Moreover, the actuator the fixed handle. The actuator handle is in mechanical connection with a plurality of fingers provided within a central hole of the annular member. Each of the plurality of fingers is able to extend inwardly or retract outwardly with respect to a central point. Rotation of the actuator handle extends or retracts the plurality of fingers. The plurality of fingers is adapted to engage a compression sock so as to aid in opening up said compression sock during the donning process whereby a user inserts a limb into said compression sock.

These together with additional objects, features and advantages of the compression sock-donning aid will be readily apparent to those of ordinary skill in the art upon reading the following detailed description of the presently preferred, but nonetheless illustrative, embodiments when taken in conjunction with the accompanying drawings.

In this respect, before explaining the current embodiments of the compression sock-donning aid in detail, it is to be understood that the compression sock-donning aid is not limited in its applications to the details of construction and arrangements of the components set forth in the following description or illustration. Those skilled in the art will appreciate that the concept of this disclosure may be readily and systems for carrying out the several purposes of the compression sock-donning aid.

It is therefore important that the claims be regarded as including such equivalent construction insofar as they do not depart from the spirit and scope of the compression sock-donning aid. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
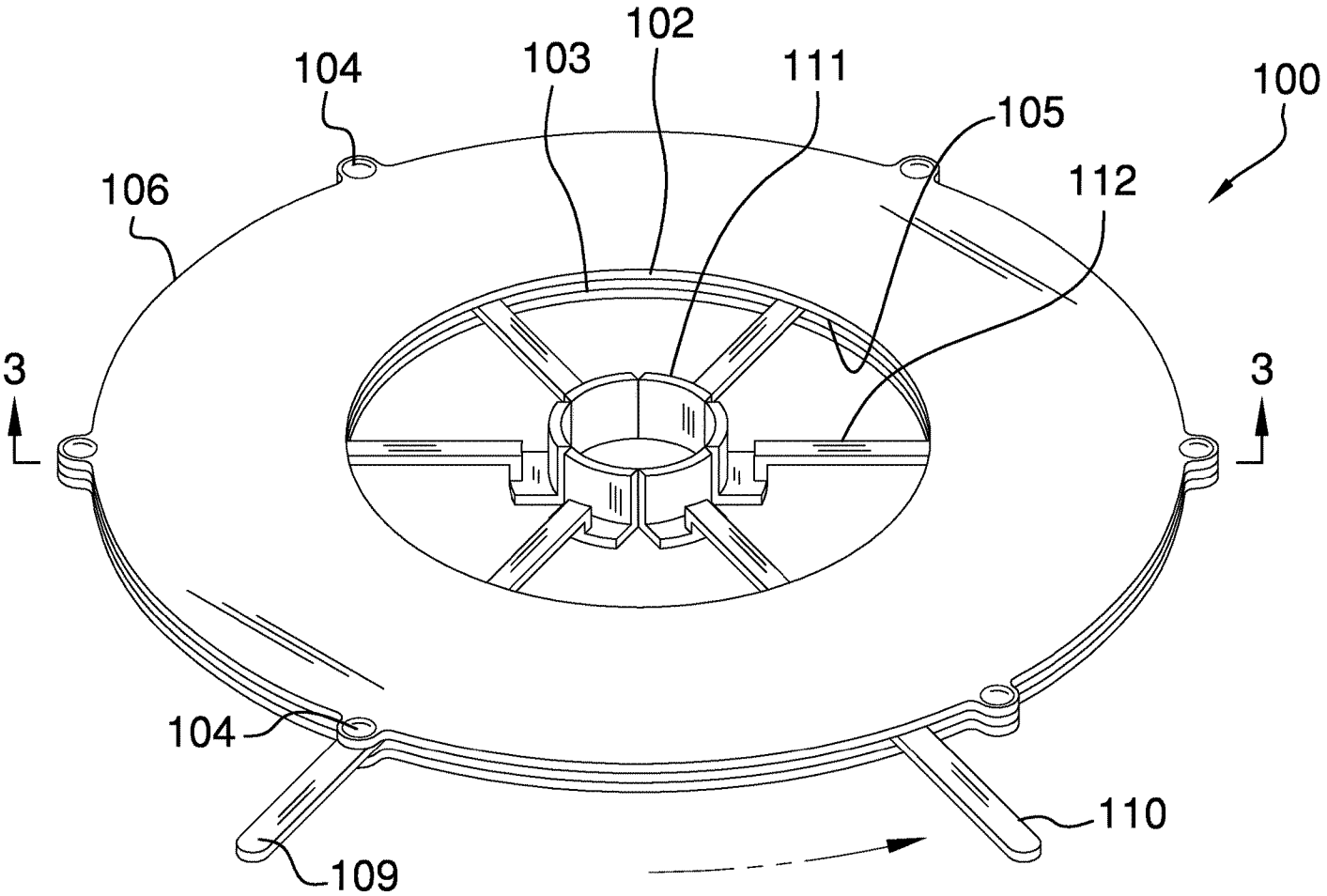
FIG. 1 is a perspective view of an embodiment of the disclosure.
Figure 2:
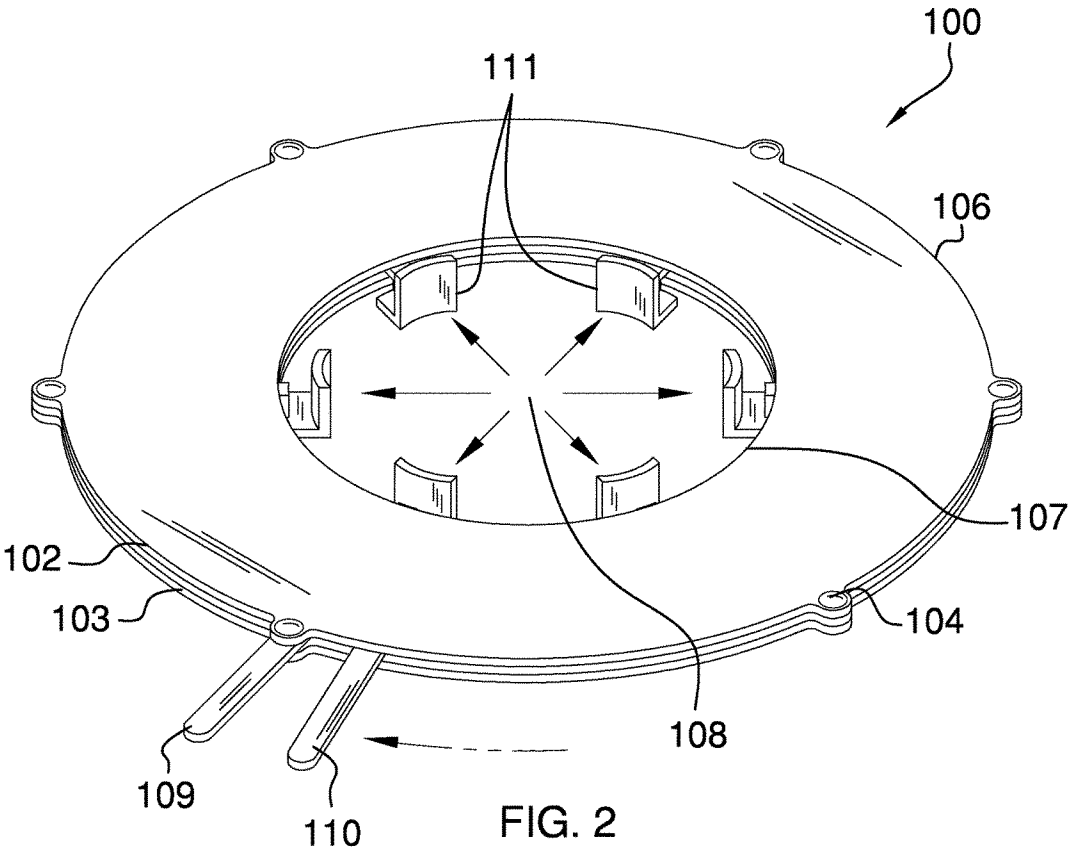
FIG. 2 is a second, perspective view of an embodiment of the disclosure.
Figure 3:
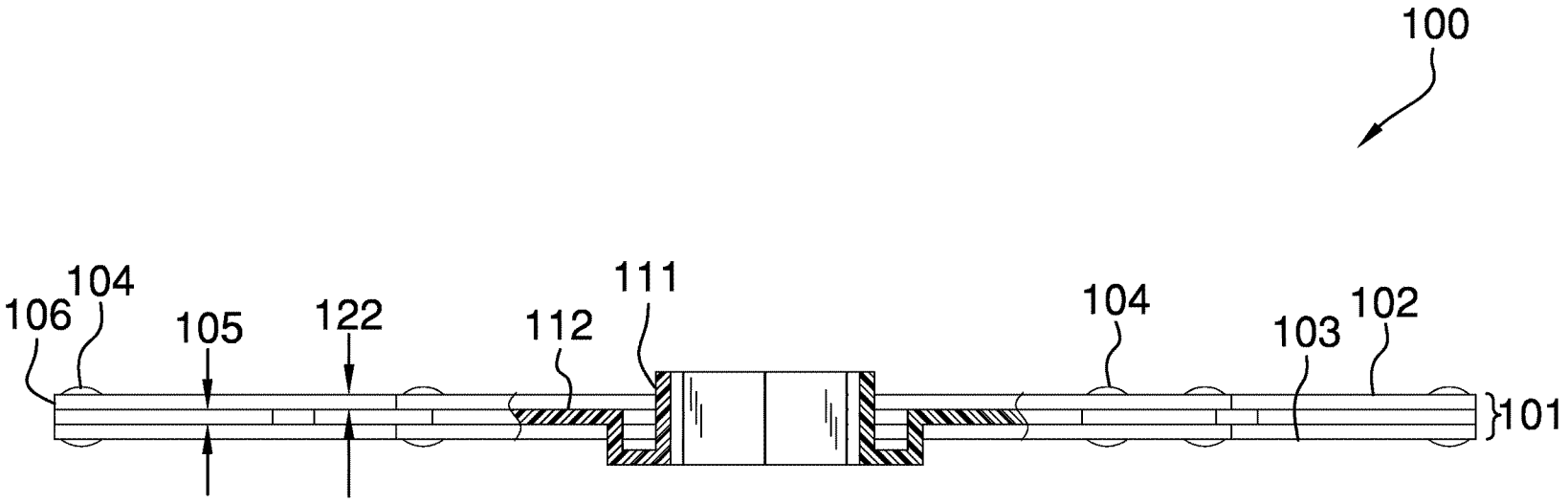
FIG. 3 is a cross-sectional view of an embodiment of the disclosure across line 4-4 in FIG. 1.
Figure 4:
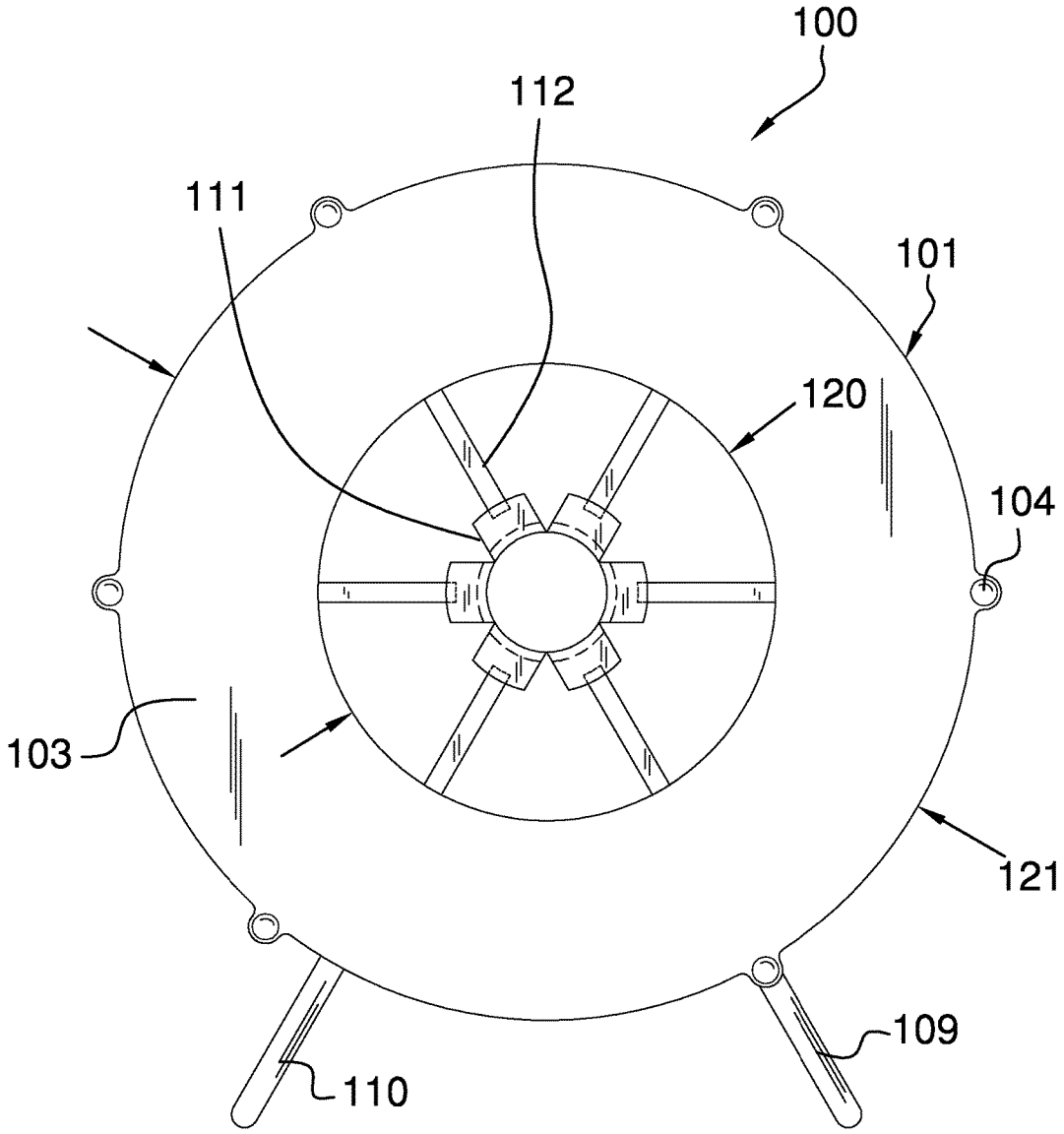
FIG. 4 is a top view of an embodiment of the disclosure.
Figure 5:
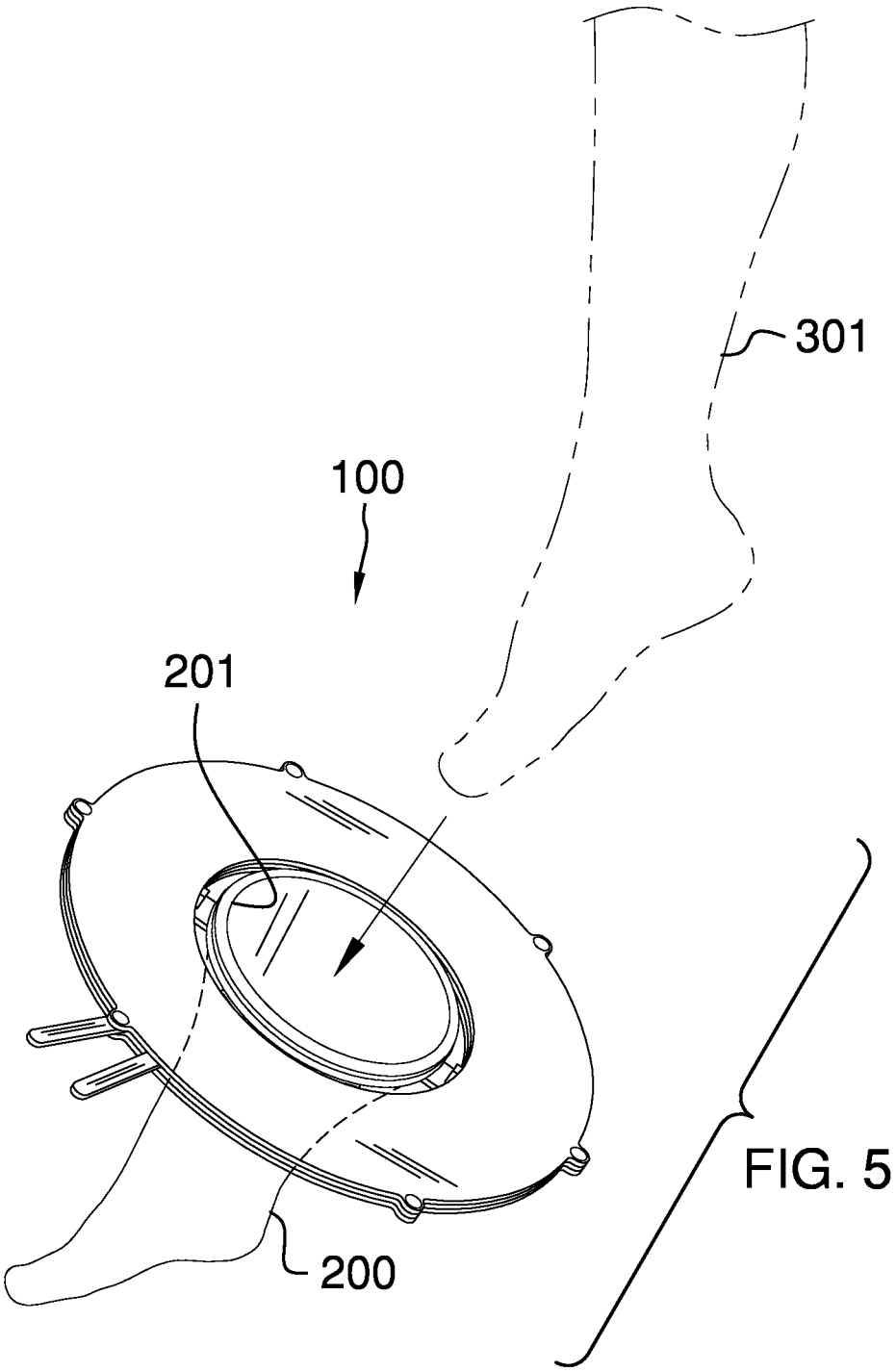
FIG. 5 is an in-use view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 6. The compression sock-donning aid 100 (hereinafter invention) is an annular member 101 formed of a top disk 102 and to the bottom disk 103 via a plurality of fasteners 104. The top disk 102 and the bottom disk 103 are separated from one another via a gap 105. The annular member 101 is further defined with an outer peripheral edge 106, an inner edge 107, and a central point 108. The plurality of fasteners 104 that affix the top disk 102 to the bottom disk 103 are located adjacent the outer peripheral edge 106.

A fixed handle 109 extends outwardly with respect to the annular member 101. Moreover, the fixed handle 109 extends outwardly with respect to the outer peripheral edge 106. The fixed handle 109 is secured between the top disk 102 and the bottom disk 103 via one of the plurality of fasteners 104. Moreover, the fixed handle 109 is positioned within the gap 105 formed between the top disk 102 and the bottom disk 103. The fixed handle 109 works in concert with an actuator handle 110 to operate the invention 100.

The actuator handle 110 extends outwardly from the annular member 101. Moreover, the actuator handle 110 extends outwardly from the gap 105 of the annular member 101. The actuator handle 110 is in mechanical connection with a plurality of finger members 111 located in the annular member 101. Moreover, the plurality of finger members 111 is able to extend inwardly plurality of finger members 111 slide away or towards the gap 105 of the annular member 101.

Each of the plurality of finger members 111 is equally spaced around the inner edge 107. Each of the plurality of finger members 111 are further defined with a gap portion 112 that slides back and forth within the gap 105 of the annular member 101. Moreover, the gap portion 112 is in mechanical connection with the actuator handle 110 such that upon rotation of the actuator handle 110, the plurality of finger members 111 either moves inwardly or outwardly with respect to the central point 108.

Each of the plurality of finger members 111 is adapted to engage a compression sock 200. Moreover, the plurality of finger members 111 is adapted to expand a sock opening 201 of the compression sock 200 thereby assisting in donning the compression sock 200 onto a limb 301 of an end user.

Figure 6:
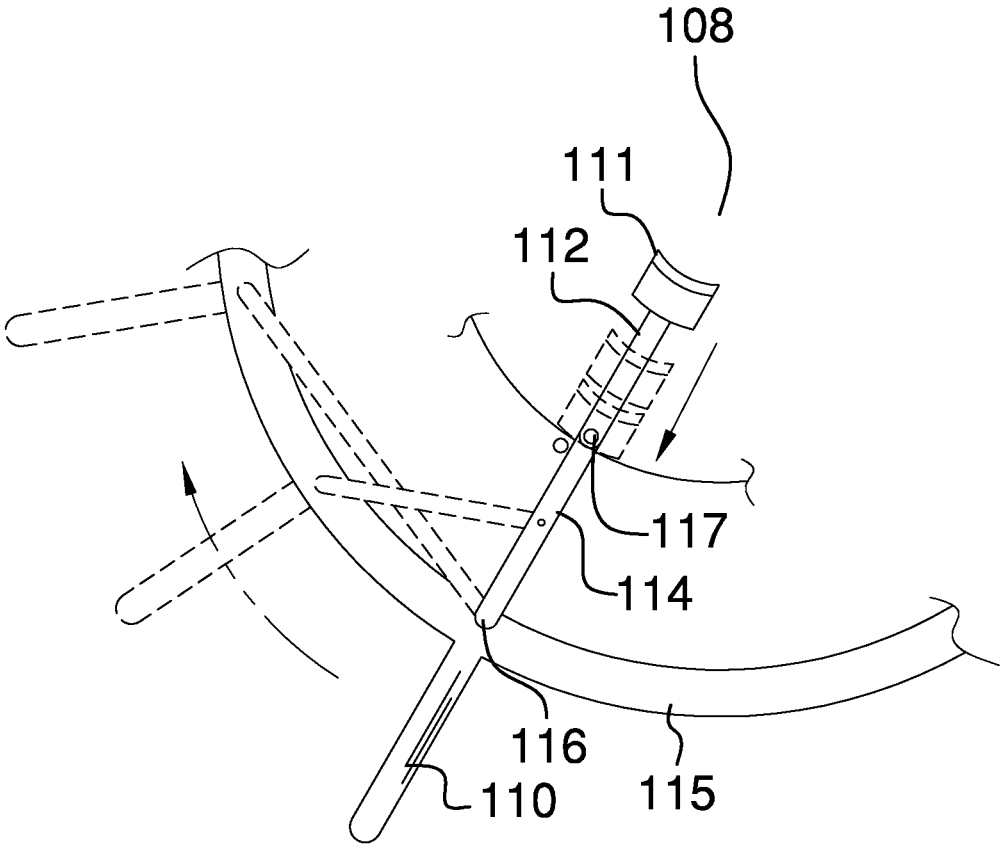
FIG. 6 is a detail view of an embodiment of the disclosure.

Referring to FIG. 6, the plurality of finger members 111 each includes the gap portion 112. Moreover, the gap portion 112 is affixed to a linkage member 114 that connects the actuator handle 110 to the respective one of the plurality of finger members 111. Moreover, the actuator handle 111 is further defined with a linkage disk 115 that extends around the gap 105 formed between the top disk 102 and the bottom disk 103. The point 116 formed with the linkage member 114. As the actuator handle 111 and the linkage disk 115 rotate with respect to the central point 108, the gap portion 112 moves inwardly or outwardly with respect to the central point 108. More the point, the linkage member 114 pivots between the linkage disk 115 and the gap portion 112. The linkage member 114 is pivotably affixed to the gap portion 112 via a second linkage pivot point 117.

The linkage member 114 and the gap portion 112 maintain linear orientation with the central point 108 via a bumper armature 118. The bumper armature 118 extends between the top disk 102 and the bottom disk 103. The bumper armature 118 enables the linkage member 114 to pivot whilst the gap portion 112 is aligned with the central point 108.

All componentry associated with the invention 100 may be made of a material comprising a wood, metal, carbon fiber composite, or plastic. The invention 100 is sized to enable the limb 301 of the end user to slide into the opening formed the inner edge 107. The annular member 107 has an inner diameter 120 that is not less than 6 inches. The inner diameter 120 defines the length of the inner edge 107. The outer peripheral edge 106 has an outer diameter 121 that is not less than 8 inches. Both the top disk 102 and the bottom disk 103 have an identical shape defined with a disk thickness 122. The disk thickness 122 shall be no less than 1 mm.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A compression sock-donning aid comprising:

an annular member that includes a plurality of finger members that are centrally aligned with respect to a central point;

wherein the plurality of finger members is adapted to engage a compression sock in order to hold a sock opening open when donning said compression sock onto a limb of an end user;

wherein the annular member is formed of a top disk and a bottom disk;

wherein the top disk is aligned with and affixed to the bottom disk via a plurality of fasteners;

wherein the top disk and the bottom disk are separated from one another via a gap;

wherein the annular member is further defined with an outer peripheral edge, an inner edge, and the central point;

wherein the plurality of fasteners that affix the top disk to the bottom disk are located adjacent the outer peripheral edge;

wherein a fixed handle extends outwardly with respect to the annular member;

wherein the fixed handle extends outwardly with respect to the outer peripheral edge;

wherein the fixed handle is secured between the top disk and the bottom disk via one of the plurality of fasteners.

2. The compression sock-donning aid according to claim 1 wherein the fixed handle is positioned within the gap formed between the top disk and the bottom disk.

3. The compression sock-donning aid according to claim 2 wherein the fixed handle works in concert with an actuator handle to operate the plurality of finger members.

4. The compression sock-donning aid according to claim 3 wherein the actuator handle extends outwardly from the annular member; wherein the actuator handle extends outwardly from the gap of the annular member; wherein the actuator handle is in mechanical connection with the plurality of finger members located in the annular member.

5. The compression sock-donning aid according to claim 4 wherein the plurality of finger members is able to extend inwardly towards or retract outwardly from the central point; wherein the plurality of finger members slide away or towards the gap of the annular member.

6. The compression sock-donning aid according to claim 5 wherein each of the plurality of finger members is equally spaced around the inner edge; wherein each of the plurality of finger members are further defined with a gap portion that slides back and forth within the gap of the annular member; wherein the gap portion is in mechanical connection with the actuator handle such that upon rotation of the actuator handle, the plurality of finger members either moves inwardly or outwardly with respect to the central point.

7. The compression sock-donning aid according to claim 6 wherein each of the plurality of finger members is adapted to engage the compression sock; wherein the plurality of finger members is adapted to expand a sock opening of the compression sock thereby assisting in donning the compression sock onto said limb of said end user.

8. The compression sock-donning aid according to claim 7 wherein the plurality of finger members each includes the gap portion; wherein the gap portion is affixed to a linkage member that connects the actuator handle to the respective one of the plurality of finger members; wherein the actuator handle is further defined with a linkage disk that extends around the gap formed between the top disk and the bottom disk; wherein the linkage disk is pivotably connected to a first linkage pivot point formed with the linkage member; wherein as the actuator handle and the linkage disk rotate with respect to the central point, the gap portion moves inwardly or outwardly with respect to the central point; wherein the linkage member pivots between the linkage disk and the gap portion; wherein the linkage member is pivotably affixed to the gap portion via a second linkage pivot point.

9. The compression sock-donning aid according to claim 8 wherein the linkage member and the gap portion maintain linear orientation with the central point via a bumper armature; wherein the bumper armature extends between the top disk and the bottom disk; wherein the bumper armature enables the linkage member to pivot whilst the gap portion is aligned with the central point.

10. The compression sock-donning aid according to claim 9 wherein the annular member has an inner diameter that is not less than 6 inches; wherein the inner diameter defines the length of the inner edge.

11. The compression sock-donning aid according to claim 10 wherein the outer peripheral edge has an outer diameter that is not less than 8 inches.

12. The compression sock-donning aid according to claim 11 wherein both the top disk and the bottom disk have an identical shape and size; wherein the top disk and the bottom disk are further defined with a disk thickness; wherein the disk thickness shall be no less than 1 mm.

* * * * *